United States Patent [19]

della Porta et al.

[11] 3,980,446

[45] Sept. 14, 1976

[54] WALL STRUCTURE FOR VACUUM ENCLOSURE

[75] Inventors: Paolo della Porta; Tiziano A. Giorgi, both of Milan, Italy

[73] Assignee: S.A.E.S. Getters S.p.A., Milan, Italy

[22] Filed: Jan. 7, 1975

[21] Appl. No.: 539,102

[30] Foreign Application Priority Data

Jan. 7, 1974 Italy ..... 19142/74

[52] U.S. Cl. ..... 29/191.4; 52/622; 220/9 C; 220/10

[51] Int. Cl.[2] ..... B31D 3/04

[58] Field of Search ..... 29/191, 191.4; 220/9 C, 220/10; 52/622

[56] References Cited

UNITED STATES PATENTS

| | | | |
|---|---|---|---|
| 3,017,971 | 1/1962 | Christman | 29/191.4 X |
| 3,139,206 | 6/1964 | Matsch | 220/9 C |
| 3,597,822 | 8/1971 | Fehlner | 29/183.5 |
| 3,620,645 | 2/1965 | della Porta | 417/48 |
| 3,679,552 | 7/1972 | Lewis | 204/37 R |
| 3,788,117 | 1/1974 | Chester et al. | 29/455 L |
| 3,872,564 | 3/1975 | Myers et al. | 29/191.4 |

*Primary Examiner*—Arthur J. Steiner

*Attorney, Agent, or Firm*—Littlepage, Quaintance, Murphy & Dobyns

[57] ABSTRACT

A wall structure comprising a first surface defining the commencement of a thickness of a metal or ceramic sheet, and a second surface defining the end of said thickness of said sheet said second surface also defining the commencement of a thickness of a three dimensional network defining a multiplicity of interconnecting free cells and a third surface defining the end of said thickness of said three dimensional network.

4 Claims, 3 Drawing Figures

WALL STRUCTURE FOR VACUUM ENCLOSURE

BACKGROUND OF THE INVENTION

1. Field of the Invention

This invention pertains generally to structural components for vacuum enclosures and particularly to structures having specific features for reducing secondary electron emission and sputtering from the walls of a vacuum enclosure and having specific features for sorbing gases.

2. Description of the Prior Art

Many devices make use of the flow of molecular atomic or subatomic particles in a controlled environment. The environment may be a vacuum or a known pressure of desired gases depending upon the function required of the particular device. The particles may be electrons or electrically charged ions or molecules. These devices are usually associated with means for accelerating the particles such as a system of electrodes whose potentials are known. Frequently use is also made of magnetic fields.

Whatever the nature of the particles may be they are usually in motion and so possess a kinetic energy.

In some cases, in order to perform their desired function, the primary particles are caused to impinge upon a target. For instance in the case of a thermionic valve electrons emitted from a cathode are accelerated by an electric potential thus gaining kinetic energy and eventually are collected upon an anode, where upon the kinetic energy of the electrons is at least partially transformed into other forms of energy.

In other cases the particles may deviate from their intended path and impinge upon surfaces within the device upon which they are not intended to impinge. Such is often the case in devices known as particle storage devices or accelerators such as cyclotrons, betatrons etc. Furthermore the controlled beam of particles may collide with molecules or atoms of the residual gas atmosphere of the device causing these molecules or atoms to undesirably impinge upon surfaces within the device.

When a particle impinges upon a surface several phenomena may occur depending upon the kinetic energy and nature of the particle and the surface. The kinetic energy of the particle may be transformed into vibrations of the atomic lattice constituting the impacted surface and thus manifests itself as heat. The energy of the particle may be transfer red to only one or a few of the atoms of the impacted surface lattice in which case these atoms may become detached from the surface. Such detached atoms can upon other surfaces within the device. This phenomenon known as sputtering is usually undesirable. The impinging particle may cause the surface to re-emit charged particles such as in the well known effect of secondary electron emission. Again such secondary emission is very often undesirable. Alternatively the particles may simply be reflected thus a surface which, intentionally or unintentionally, is impinged upon by particles can cause undesirable effects.

In patent application Ser. No. 539,101, filed Jan. 7, 1975 there are described charged particle collecting bodies or traps comprising a three dimensional network defining a multiplicity of inter-connecting free cells such that a large percentage of the charged particles, incident upon the surface defining said network pass through said surface without impinging upon the material constituting said network. Said network allows at least part of said percentage of charged particles to impinge upon the material of said network at a position below the surface defining said network. Thus secondary electrons produced below the surface find difficulty in escaping from said surface and tend to be captured by collision with the surrounding network.

In practice such charged particle collecting bodies have to be carefully machined or formed to shape before being located in their desired position. Difficulties can be encountered in rigidly attaching the particle collecting body within the vacuum enclosure due to differences in thermal expansion coefficients of the materials used to make the vacuum vessel walls and the particle collecting bodies. Attachment by means of bolts or similar devices can strain the enclosure walls and in extreme cases could lead to loss of integrity of the vacuum enclosure, or deformation of the particle collecting body.

A further difficulty in many vacuum enclosures is the production and maintenance of a suitable degree of vacuum. In large vacuum enclosures such as particle accelerators many vacuum pumps are required, distanced around the enclosure. Never the less in the space between two pumping appertures within the enclosure there may manifest itself a relatively high pressure region of gases desorbed from the enclosure walls due to the distance separating that region from the nearest pump, even though the pump may be in continuous operation during normal working of the vacuum device comprising the enclosure. In other vacuum enclosures it may not be desirable to operate the pumps after initial creation of the desired vacuum. It is then difficult to ensure maintenence of this vacuum during operation of the vacuum device comprising the vacuum enclosure.

It is therefore an object of the present invention to provide a wall structure for a vacuum enclosure which is substantially free from one or more of the defects of previously known walls of vacuum enclosures.

Another object of the present invention is to provide a wall structure for a vacuum enclosure which is substantially free from sputtering.

Another object of the present invention is to provide a wall structure for a vacuum enclosure which is substantially free from secondary electron emission.

A further object of the present invention is to provide a wall structure for a vacuum enclosure which is capable of sorbing gases.

Further objects and advantages of the wall structure for a vacuum enclosure of the present invention will be obvious to those skilled in the art from the following detailed description thereof taken in conjunction with the accompanying figures.

DESCRIPTION OF PREFERRED EMBODIMENTS

Figure 1:
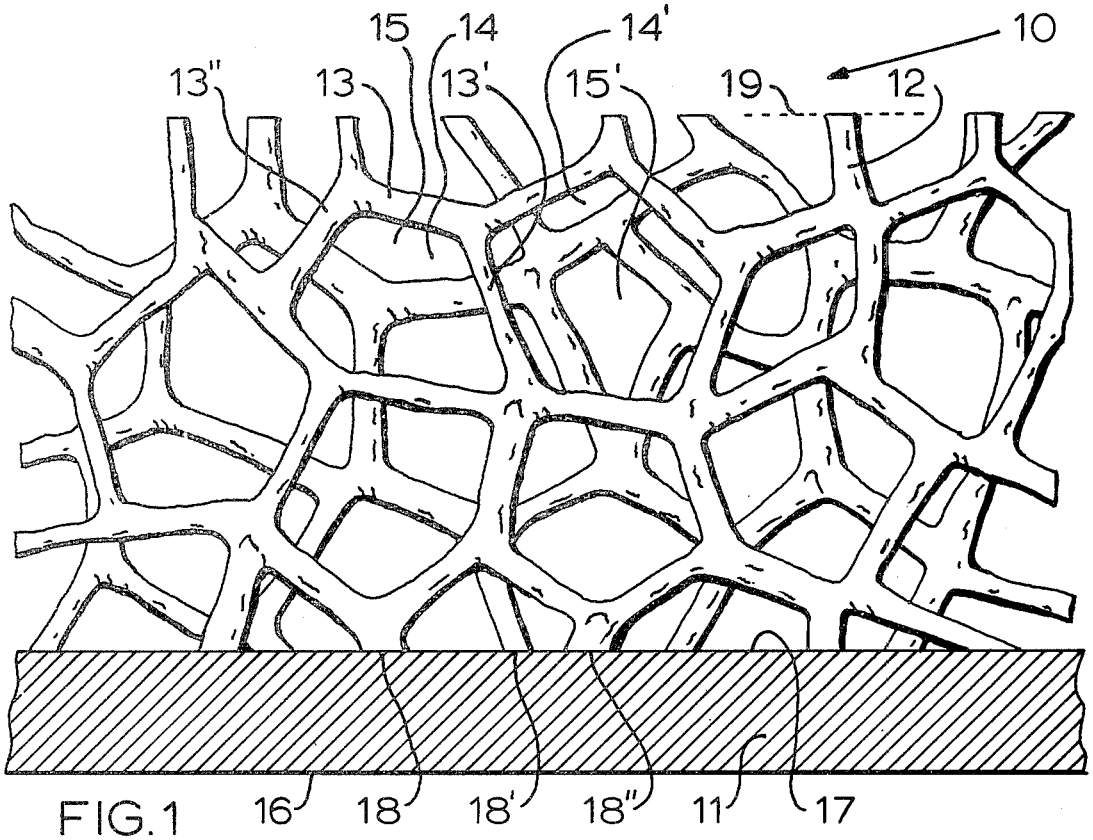
FIG. 1 is a cross sectional representation of a wall structure for a vacuum enclosure of the present invention.

According to the present invention there is provided a wall structure for a vacuum enclosure comprising a continuous metallic or ceramic sheet forming a vacuum barrier integrally attached to a body comprising a three dimensional network defining a multiplicity of interconnecting free cells. Optionally at least part of the interconnecting free cells may contain particulate getter material.

Such three-dimensional networks are well known and methods for their preparation are illustrated in United Kingdom Pat. Nos. 1,263,704 and No. 1,289,690. See also U.S. Pat. No. 3,679,552. These three-dimensional networks have been used in the past to trap air born particles such as dust or pollen. Presumably they act by changing the flow characteristics of the dust carrying air and functioning as a mechanical filter as the pore size of the filter is smaller than the size of the dust particle. What ever the means by which the dust particles are trapped they impinge upon the network with such a low energy per unit mass that secondary emission or sputtering phenomena do not occur.

It has been found that when a body comprised of a three dimensional network defining a multiplicity of interconnecting free cells is impinged upon by molecular, atomic or subatomic particles, having sufficient energy, to cause secondary emission or sputtering, there is a reduced secondary emission and sputtering when compared to traditional surfaces.

In the broadest sense of the present invention the body may be of any material capable of being fabricated into a three-dimensional structure defining a multiplicity of interconnecting free cells. However the material should be capable of withstanding the conditions of manufacture and use of the device in which the surface is to be situated.

Non-limiting examples of materials suitable for use as the three-dimensional network are graphite, nickel, chromium, iron, titanium, tungsten, cobalt, molybdenum and alloys of these materials between themselves and with other materials.

In general the cell size of the body material is any size that can be conveniently produced with the material to be used for the body. The preferred cell size is less than 10 cells per inch and preferably less than 25 cells per inch. At a lower number of cells per inch the body is too transparent and is not able to collect the primary particles unless there is an excessive thickness of the three-dimensional network comprising the particle collecting body. There is essentially no upper limit to the number of cells per inch except that imposed by present technology in fabricating such three dimensional networks.

The present limit is about 200 cells per inch but there is no reason why networks having a higher number of cells per inch should not be useful in the present invention.

When a primary particle passes through the surface, which defines the volume containing the three-dimensional network, in general it does not impinge directly upon the material constituting the network but passes through the spaces therein.

After passing some distance below the surface the primary particle strikes the material constituting the network and, depending upon the nature of the primary particle, its energy and the nature of the material constitutitng the network, causes to varying degrees heating, sputtering and/or secondary particle emission. This sputtering or secondary particle emission now takes place in a zone at least partially enclosed by the three-dimensional network. Thus the secondary particles are more likely to re-collide with the structure of the material constituting the network than escape from the surface. In this way the sputtered atoms or particles emitted are effectively trapped. It will be appreciated that a certain percentage of the primary particles will impinge upon the material, constituting the network, in the region near the surface defining the volume containing said network. However this percentage is generally no more than about 10 to 20 per cent of the incident primary particles. This actual percentage depends upon the thickness of the individual arms of the network relative to the cell size. A measure of this ratio is given by the ratio of apparent density of the three-dimensional network to the density of the bulk material constituting the network. The ratio of apparent density to bulk density should be between 1 to 2 and 1 to 100 and preferably between 1 to 5 and 1 to 50. At lower ratios of apparent density to bulk density the network has a low porosity and is incapable of trapping a sufficient proportion of sputtered or secondary particles. If the ratio of apparent density to bulk density is too high the network has too high a porosity and an excessive thickness of network is required to trap the primary particles.

The network may be attached to the metal or ceramic sheet by any suitable means. The metal sheet and network may be heated and then compressed together such that a welding action takes place at the points of contact.

Alternatively cold friction welding may be used or electric current may be passed through the sheet/network assembly to weld the points of contact.

An outer portion of the cells may be filled with a metal or ceramic powder such that upon sintering a continuous layer is produced integral with the network. This layer can be subsequently electroplated with additional metal if desired, to ensure complete lack of porosity.

These processes can be applied to the sheet and network already in their finally desired shape or the structure may be made in flat sheets and later cut or formed to the desired shape of wall structure.

The wall structure may optionally be used the support a getter material, as described in patent application Ser. No. 424,710 of Dec. 14, 1973, in order to ensure the maintenance of the desired degree of vacuum in the enclosure. Whilst it is possible to support a getter material in any suitable place within the vacuum enclosure it is particularly advantageous to use the wall structure. In this way the getter material itself is protected from being impinged upon by particles which provoke secondary emission or sputtering.

Such getter materials usually comprise metals or metal alloys or compounds either singly or in admixture or mixed with other materials.

In operation such getter materials sorb gases to form, in general, chemical compounds on the surface of the getter material. If such compounds remain on the getter material surface they usually present a higher degree of secondary emission than the unreacted getter material. This disadvantage of the use of getter materials is considerably reduced by locating the getter material within the wall structure. Examples of suitable getter materials are also described in patent application Ser. No. 424,710 of Dec. 14, 1973.

Particularly suitable getter materials comprise:

1. a powered non-evaporable getter metal comprising at least one metal chosen from the group Zr, Ta, Hf, Nb, Ti, Th and U, and 2. a powdered anti-sintering material wherein the weight ratio of 1) to 2) is from 20:1 to 2:1.

Referring now to the drawings and in particular to FIG. 1 there is shown a wall structure 10 for a vacuum enclosure comprising a continuous metallic sheet 11 and a three dimensional network 12. Struts 13, 13′, 13″ of network 12 define opern surfaces 14, 14′ etc. between interconnecting cells 15, 15′, etc. within the three dimensional network 12.

Continuous metal sheet 11 comprises a first surface 16, which is generally outwardly facing, that is it finds itself on the higher pressure side of the vacuum vessel, and a second surface 17, which is generally inwardly facing, that is it finds itself on the lower pressure or vacuum side of the vacuum vessel. To the second surface 17 is attached three dimensional network 12 at positions 18, 18′, 18″ etc. which are positions of intersection of three dimensional network 12 with sheet 11. Network 12 extends specially from surface 17 to define a particle incident surface 19.

Figure 2:
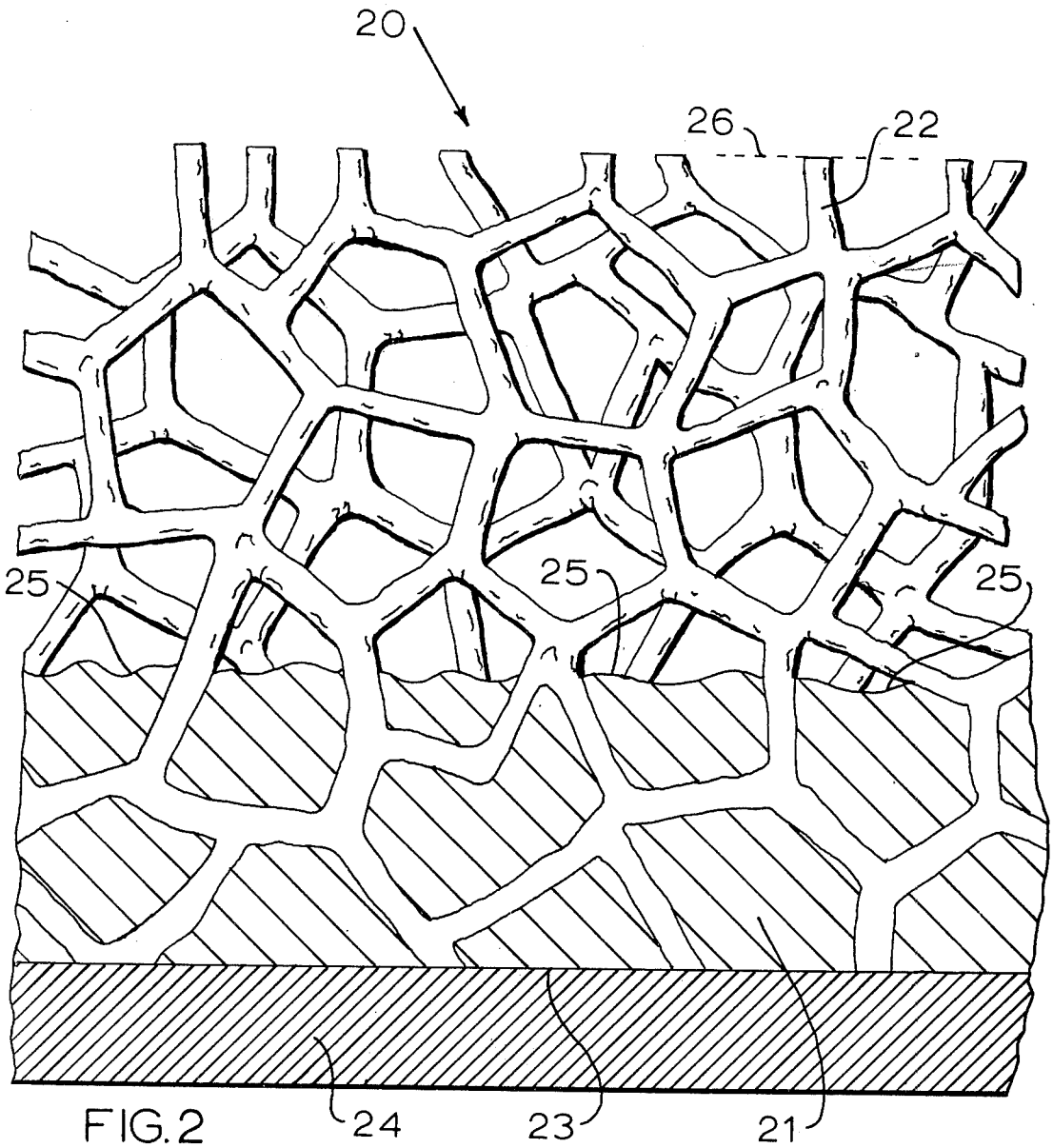
FIG. 2 is a cross sectional representation of another wall structure for a vacuum enclosure of the present invention.

FIG. 2 shows a wall structure 20, similar to the structure 10 of FIG. 1. However there is now present a getter material 21 supported in three dimensional network 22. Getter material 21 is in contact with second surface 23 of a sintered ceramic sheet 24. Surface 25 which defines the extent of the getter material 21 lies between surface 23 and surface 26.

Surface 26 is the particle incident surface defining the spacial extent of three dimensional network 26.

Figure 3:
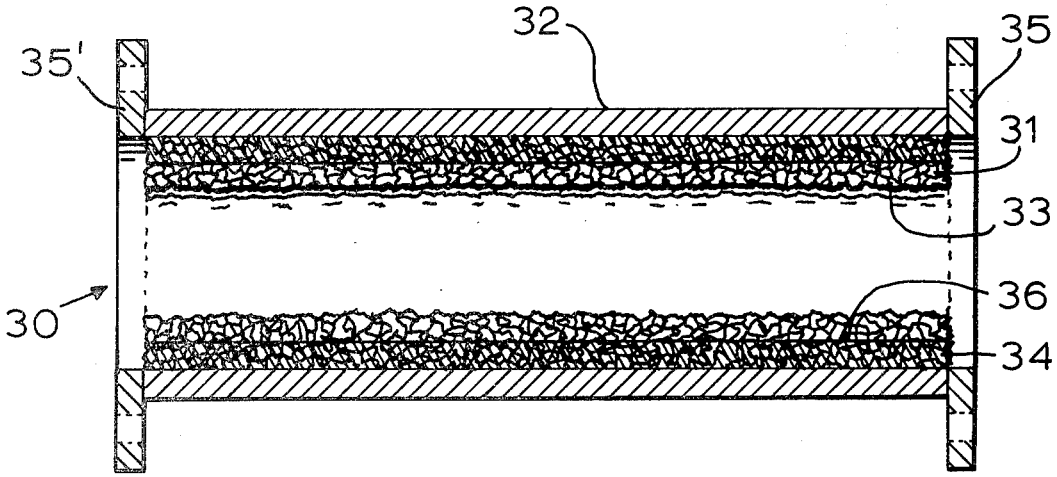
FIG. 3 is a cross sectional representation of another wall structure for a vacuum enclosure of the present invention.

FIG. 3 shows a cross section of a tubular element 30 comprising a three dimensional network 31 whose outer surface 32 has been rendered vacuum tight. Three-dimensional network 31 also has an inner surface 33. Situated between inner surface 33 and outer surface 32 is placed a powdered getter material 34 in such a way that surface 36 of getter material 34 remains below inner surface 33 of getter material 34. Gaskets 35, 35′ are attached to the ends of the tubular element 30.

What we claim is:

1. A wall structure for a vacuum enclosure comprising:

a. a first surface defining the commencement of a thickness of a metal or ceramic sheet, and b. a second surface defining the end of said thickness of said sheet, said sheet forming a vacuum barrier, and said second surface also defining the commencement of a thickness of a three dimensional metallic network defining a multiplicity of interconnecting free cells wherein there are more than 10 free cells per inch and the ratio of apparent density of the network to the density of the bulk material constituting the network is between 1 to 2 and 1 to 100, in which the metal of said network comprises a material chosen from the group Ni, Cr, Fe, Ti, Co, Mo and alloys of these metals between themselves and with other metals, and c. a third surface defining the end of said thickness of said three dimensional network, and d. a getter material contained within at least some of said free cells, the getter material comprising a powdered non-evaporable getter metal comprising at least one metal chosen from the group Zr, Ta, Hf, Nb, Ti, Th and U.

2. A wall structure for a vacuum enclosure comprising:

a. a first surface defining the commencement of a thickness of a metal or ceramic sheet, and b. a second surface defining the end of said thickness of said sheet, said sheet forming a vacuum barrier, and said second surface also defining the commencement of a thickness of a three dimensional metallic network defining a multiplicity of interconnecting free cells wherein there are more than 25 free cells per inch and the ratio of apparent density of the network to the density of the bulk material constituting the network is between 1 to 5 and 1 to 50, in which the metal of said network comprises a material chosen from the group Ni, Cr, Fe, Ti, Co, Mo and alloys of these metals between themselves and with other metals, and c. a third surface defining the end of said thickness of said three dimensional network, and d. a getter material contained within at least some of said free cells, the getter material comprising a powdered non-evaporable getter metal comprising at least one metal chosen from the group Zr, Ta, Hf, Nb, Ti, Th and U.

3. A wall structure comprising:

a. a first surface defining the commencement of a thickness of a metal or ceramic sheet, and b. a second surface defining the end of said thickness of said sheet said second surface also defining the commencement of a thickness of a three dimensional metallic network defining a multiplicity of interconnecting free cells wherein there are more than 25 free cells per inch and the ratio of apparent density of the network to the density of the bulk material constituting the network is between 1 to 5 and 1 to 50, in which the metal of said network comprises a material chosen from the group Ni, Cr, Fe, Ti, Co, Mo and alloys of these metals between themselves and with other metals, and c. a third surface defining the end of said thickness of said three dimensional network, d. a getter material comprising:

1. a powdered non-evaporable getter metal comprising at least one metal chosen from the group Zr, Ta, Hf, Nb, Ti, Th and U, and 2. a powdered anti-sintering material wherein the weight ratio of 1) to 2) is from 20:1 to 2:1;

Wherein said getter material is contained within at least some of said free cells the spacial extent of said getter material being between said second surface and a fourth surface where said fourth surface lies between said second surface and said third surface.

4. A vessel for enclosing a volume at subatmospheric pressure whose walls comprise a structure as defined in any of claim 3.

* * * * *